US010745924B2

(12) United States Patent
Jean

(10) Patent No.: US 10,745,924 B2
(45) Date of Patent: Aug. 18, 2020

(54) ANGLE ADJUSTABLE TREAD HOLDING BRACKETS FOR STAIRCASES

(71) Applicant: Regis Jean, Montreal-Nord (CA)

(72) Inventor: Regis Jean, Montreal-Nord (CA)

( * ) Notice: Subject to any disclaimer, the term of this patent is extended or adjusted under 35 U.S.C. 154(b) by 184 days.

(21) Appl. No.: 15/613,128

(22) Filed: Jun. 2, 2017

(65) Prior Publication Data

US 2017/0356196 A1 Dec. 14, 2017

(30) Foreign Application Priority Data

Jun. 10, 2016 (GB) ..... 1610200.6

(51) Int. Cl.

| | |
|---|---|
| ***E04B 1/38*** | (2006.01) |
| ***E04F 21/26*** | (2006.01) |
| ***E04F 11/025*** | (2006.01) |
| ***E04F 11/104*** | (2006.01) |

(52) U.S. Cl.

CPC ..... *E04F 21/26* (2013.01); *E04F 11/025* (2013.01); *E04F 11/1041* (2013.01)

(58) Field of Classification Search

None

See application file for complete search history.

(56) References Cited

U.S. PATENT DOCUMENTS 493,048 A * 3/1893 Alstine ..... B25H 7/04 33/420
553,467 A 1/1896 Godfrey
947,422 A * 1/1910 Sherry ..... B43L 7/14 249/14
1,363,418 A 12/1920 Jacobs
1,768,650 A * 7/1930 Wise ..... B66B 9/083 187/201
2,760,239 A * 8/1956 Freddie ..... E04F 11/025 52/183
3,299,590 A 1/1967 Carter
3,331,579 A * 7/1967 Petersen ..... E04G 13/06 249/14
3,470,664 A 10/1969 Whitehead
4,003,179 A * 1/1977 Gilb ..... E04B 1/2608 52/696
4,959,935 A 10/1990 Stob
5,131,197 A 7/1992 Varga
5,337,879 A * 8/1994 Fischer ..... B66B 23/12 198/333
5,806,254 A 9/1998 Bennett
7,946,084 B2 * 5/2011 Gibson ..... E04F 11/1043 52/182
7,954,249 B1 * 6/2011 Perkey ..... B43L 7/027 33/427

(Continued)

*Primary Examiner* — Basil S Katcheves

(57) ABSTRACT

An angle adjustable tread holding bracket comprising a first bracket member having a first triangular shaped body member including a first opening; and a second bracket member rotationally attached to the first bracket member via a pin hinge member, wherein the second bracket member includes a second triangular shaped body member having a U-shaped slot allowing the first triangular shaped body member of the first bracket member to be inserted into the U-shaped slot enabling the angle of the tread holding bracket to be adjusted, wherein the second triangular shaped body member includes an arcuate groove and a second opening.

7 Claims, 3 Drawing Sheets

(56) References Cited

U.S. PATENT DOCUMENTS

| | | | | |
|---|---|---|---|---|
| 8,960,368 | B2 | 2/2015 | Stanaland | |
| 2004/0049934 | A1* | 3/2004 | Huff | B27M 3/12 33/562 |
| 2005/0081461 | A1* | 4/2005 | Gibson | E04F 11/00 52/188 |

* cited by examiner

ANGLE ADJUSTABLE TREAD HOLDING BRACKETS FOR STAIRCASES

CROSS-REFERENCE TO RELATED APPLICATIONS

The present application claims priority to United Kingdom Patent Application serial number 1610200.6, filed on Jun. 10, 2016 entitled "Angle adjustable thread holding brackets for staircases", the disclosure of which is hereby incorporated in its entirety at least by reference.

BACKGROUND OF THE INVENTION

1. Field of the Invention

The present invention generally relates to staircases, but more particularly to angle adjustable tread holding brackets for staircases.

2. DESCRIPTION OF RELATED ART

There are many types of staircases and a plurality of construction methods. A popular method for residential construction, both for indoor and outdoor staircases is to use a pair of stringers having a saw tooth pattern onto which are applied risers and tread planks forming the steps. The most common angle for the stringers is 39 degrees, but staircases can have other inclinations, such as 30 degrees for example. This is particularly true for staircases leading up to an exterior deck where, for design purposes, one would want the staircase to have a different angle to its steps. Although stringers made for a 39 degree drop are quite common, other angles are not so easy to find. If one wants to make custom stringers, the calculations can be tricky and errors can be made. Consequently, angle adjustable tread holding brackets for staircases are needed to provide an easy way to customize staircases.

BRIEF SUMMARY OF THE INVENTION

In one embodiment of the present invention an angle adjustable tread holding bracket is provided, comprising: a first bracket member having a first triangular shaped body member including a first opening; a second bracket member rotationally attached to the first bracket member via a pin hinge member, wherein the second bracket member includes a second triangular shaped body member having a U-shaped slot allowing the first triangular shaped body member of the first bracket member to be inserted into the U-shaped slot enabling the angle of the tread holding bracket to be adjusted, wherein the second triangular shaped body member includes an arcuate groove and a second opening; a bolt element positioned through the first opening and into the arcuate groove configured to define a rotational range of motion corresponding to the angle of the tread holding bracket; an anchor member attached to a bottom portion of the first triangular shaped body member, wherein the anchor member is configured to be attached to a stringer member of a staircase; and a tread plate attached to a top portion of the second triangular shaped body member, wherein the tread plate is attached to an underside of a tread of the staircase.

In one embodiment, the first triangular shaped body member includes a first flange on the bottom portion of the first triangular shaped body member. In one embodiment, the anchor member includes a second flange and the anchor member is mechanically attached via a connection between the first flange and the second flange. In another embodiment, the anchor member includes a plurality of holes allowing the passing of a plurality of mechanical fasteners configured to attach and secure the anchor member to the stringer member of the staircase. In one embodiment, the anchor member includes at least one oblong opening for the passing of at least one of the plurality of mechanical fasteners, wherein the at least one oblong opening allows a limited sliding motion along the stringer allowing spacing between the first and second bracket members to be adjusted. In yet another embodiment, the angle is locked by tightening a pair of screws positioned in the second opening. In one embodiment, the angle is adjustable from 30 to 45 degrees.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide angle adjustable tread holding brackets for staircases.

Figure 1:
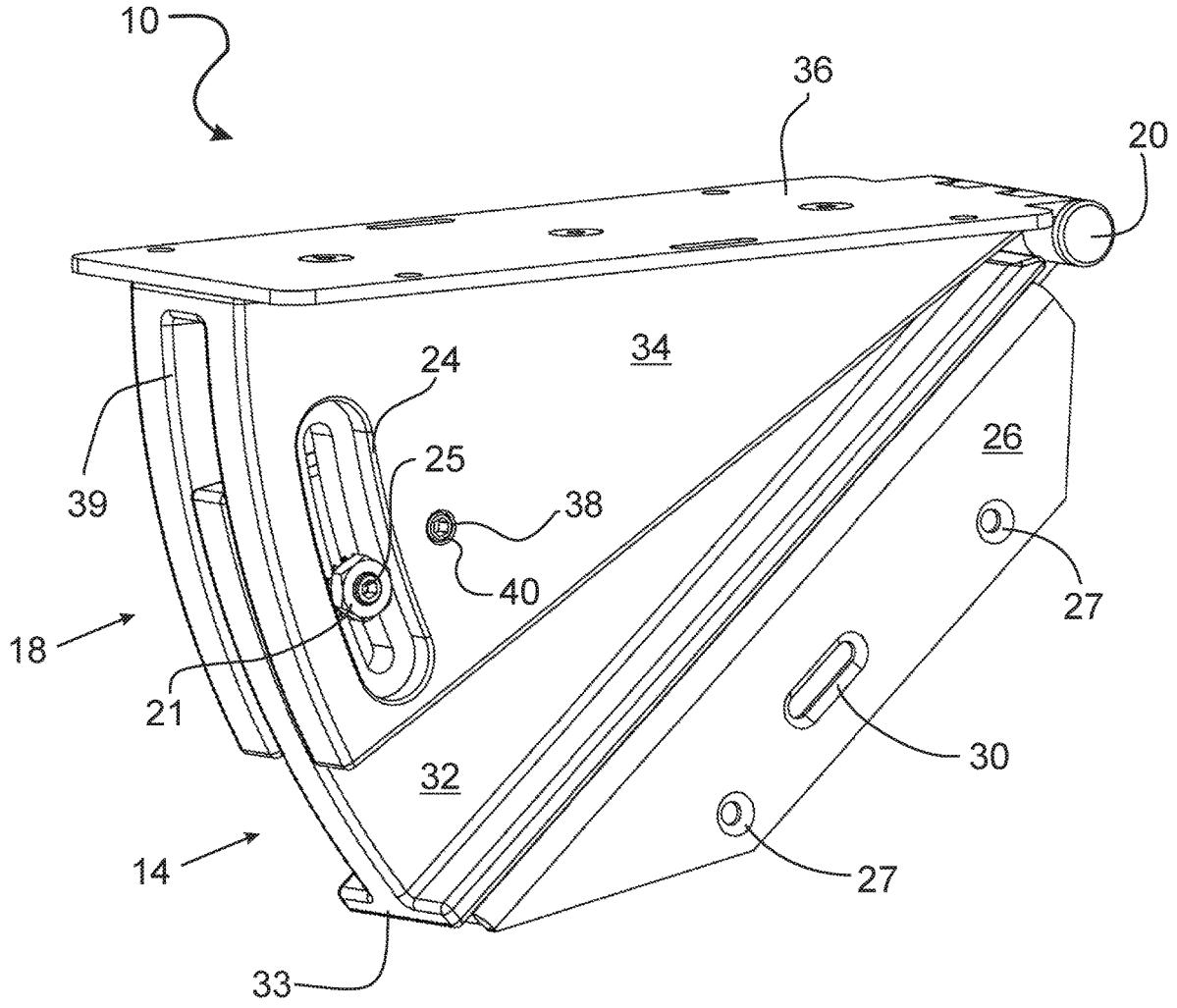
FIG. 1 is a perspective view of an angle adjustable tread holding bracket for staircases according to an embodiment of the present invention.
Figure 2:
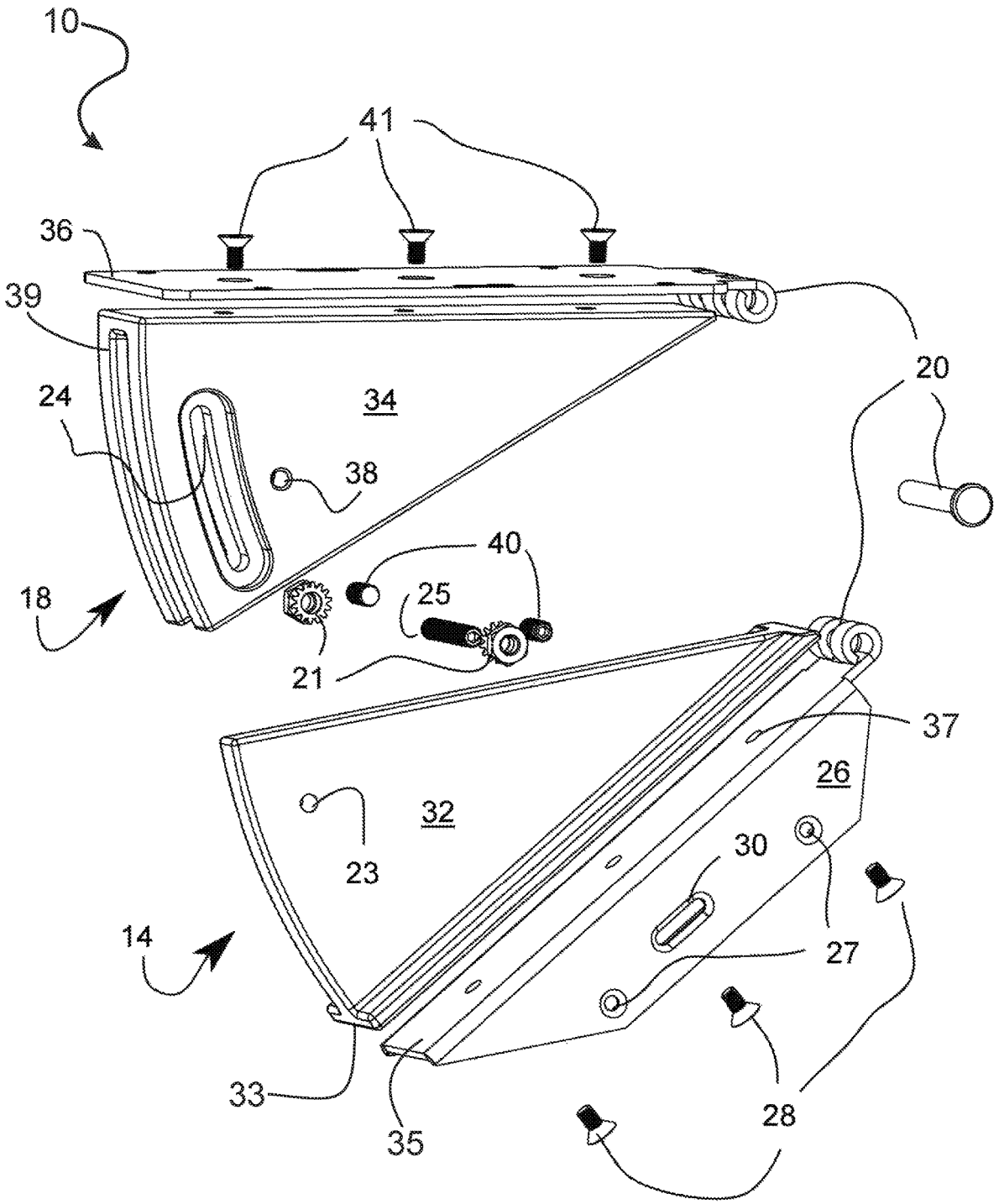
FIG. 2 is an exploded view of FIG. 1.

FIGS. 1 and 2 illustrate various views of an angle adjustable tread holding bracket 10 for staircases according to an embodiment of the present invention. Referring now to FIGS. 1 and 2, the angle adjustable tread holding bracket comprises a first bracket member 14 and a second bracket member 18 rotationally attached via a pin hinge member 20. The first bracket member includes a first triangular shaped body member 32 having a first flange 33 on a bottom edge of the body member and a first opening 23. In one embodiment, an anchor member 26 is provided, wherein the anchor member includes a second flange 35. In one embodiment, the anchor member is attached to the triangular shaped body member via the first and second flanges using any suitable attachment means 37 well known in the art, including but not limited to mechanical fasteners.

Figure 3A:
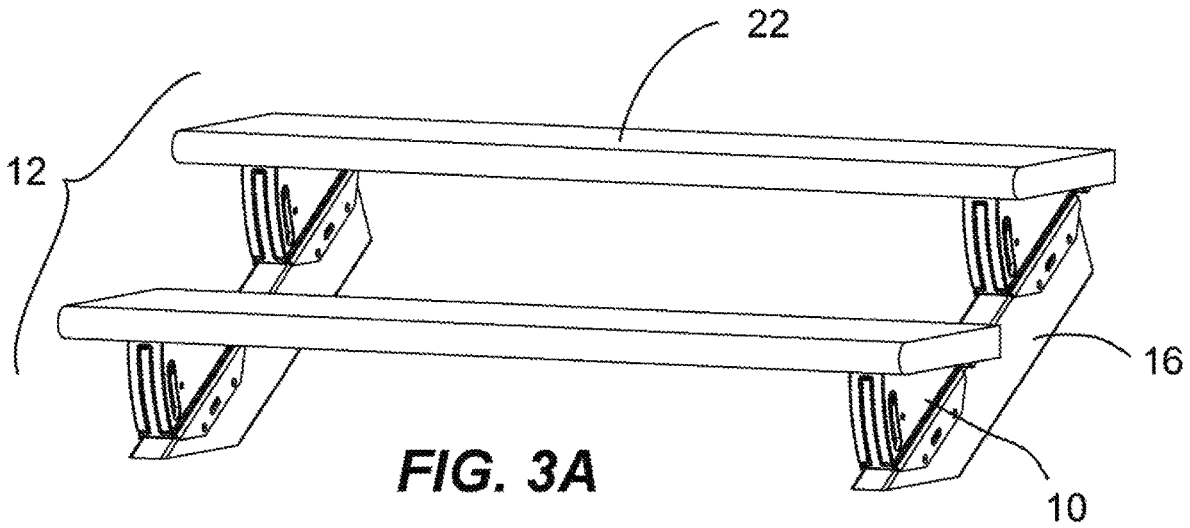
FIGS. 3A-C are perspective views of an angle adjustable tread holding bracket for staircases at various angles according to an embodiment of the present invention.

In one embodiment, the anchor member includes a plurality of holes 27 allowing the passing of a first plurality of mechanical fasteners 28 configured to attach and secure the anchor member to a stringer member 16 (FIG. 3A) of a staircase 12 (FIG. 3A). The staircase and in particular the angle of the holding brackets in relation the stringer member will be discussed in greater detail below.

In one embodiment, the anchor member further includes at least one oblong opening 30 for the passing of at least one of the first plurality of mechanical fasteners, wherein the at least one oblong opening allows a limited sliding motion along the stringer allowing the spacing between holding brackets to be adjusted as necessary.

Still referring to FIGS. 1 and 2, the second bracket member includes a second triangular shaped body member 34 including a U-shaped slot 39 allowing the first triangular shaped body member of the first bracket member to be inserted into the U-shaped slot enabling the angle of the holding bracket to be adjusted. In one embodiment, the second bracket member further includes an arcuate groove 24 and a second opening 38. Specifically, the angle is adjusted by way of a pair of washers and nut 21 treaded onto a socket head bolt 25 partially engaged into the first opening and moving within the arcuate groove, wherein the arcuate groove defines a rotational range of motion. In one embodiment, the range of motion is 30 to 45 degrees. The second opening extends through the entire second triangular shaped body member, which is on both sides of the U-shaped slot. In one embodiment, the angle is locked by tightening a pair of small socket head cap screws 40, which locks the second triangular shaped body member on the first triangular shaped body member.

In one embodiment, a tread plate 36 is attached to the second triangular shaped body member via a second plurality of mechanical fasteners 41. The tread plate is mechanically attached to an underside of a tread 22 (FIG. 3A).

Figure 3B:
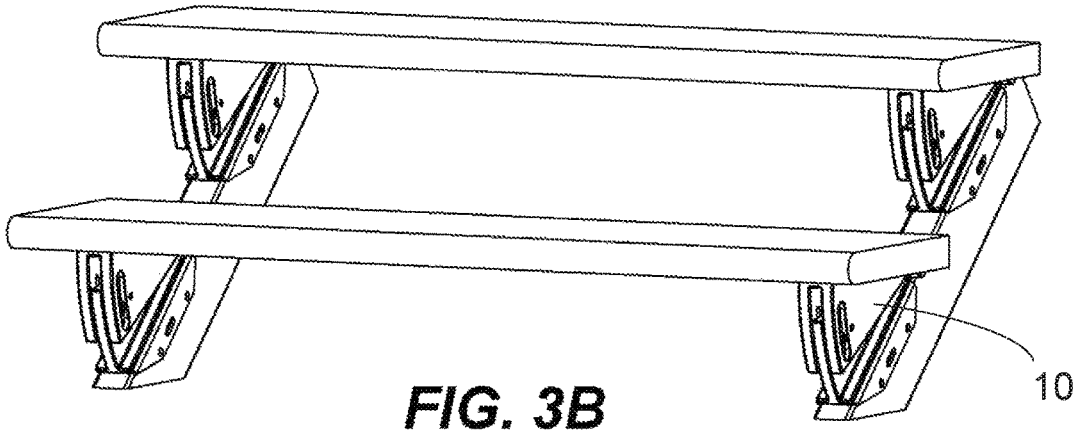
Figure 3C:
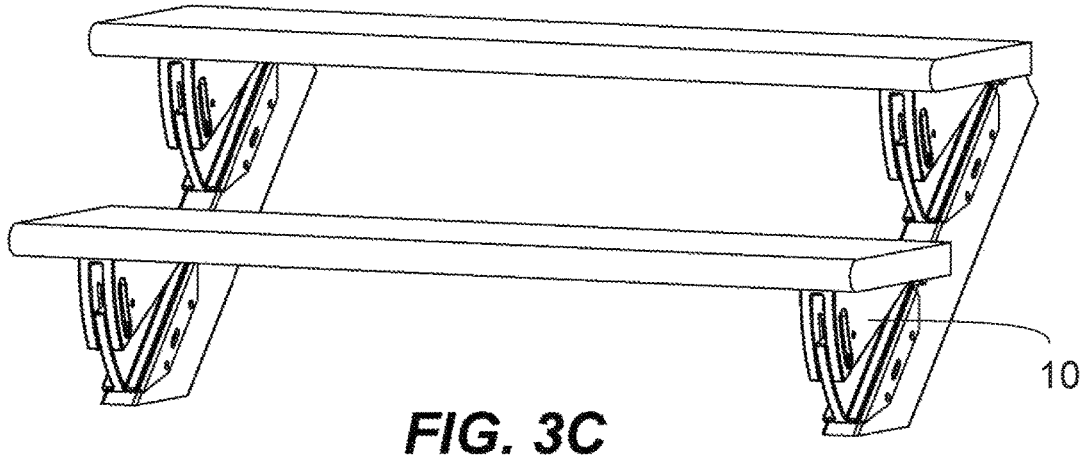

FIGS. 3A-C are perspective views of angle adjustable tread holding brackets 10 for staircases 12 at various angles according to an embodiment of the present invention. Referring now to FIG. 3A, the angle adjustable tread holding brackets are positioned to a 30 degree angle. Referring now to FIG. 3B, the angle adjustable tread holding brackets are positioned to an angle greater than 30 degrees but less than 45 degrees. Referring now to FIG. 3C, the angle adjustable tread holding brackets are positioned to a 45 degree angle. It is a particular advantage of the present invention, that by adjusting the angle of the brackets, a custom designed staircase may be easily created.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. An angle adjustable tread holding bracket comprising:

a first bracket member having a first triangular shaped body member including a first opening;

a second bracket member rotationally attached to the first bracket member via a pin hinge member, wherein the second bracket member includes a second triangular shaped body member having a U-shaped slot allowing the first triangular shaped body member of the first bracket member to be inserted into the U-shaped slot enabling an angle of the tread holding bracket to be adjusted, wherein the second triangular shaped body member includes an arcuate groove and a second opening;

a bolt element positioned through the first opening and into the arcuate groove configured to define a rotational range of motion corresponding to the angle of the tread holding bracket;

an anchor member attached to a bottom portion of the first triangular shaped body member, wherein the anchor member is configured to be attached to a stringer member of a staircase; and a tread plate attached to a top portion of the second triangular shaped body member, wherein the tread plate is attached to an underside of a tread of the staircase.

2. The angle adjustable tread holding bracket of claim 1, wherein the first triangular shaped body member includes a first flange on the bottom portion of the first triangular shaped body member.

3. The angle adjustable tread holding bracket of claim 2, wherein the anchor member includes a second flange and the anchor member is mechanically attached via a connection between the first flange and the second flange.

4. The angle adjustable tread holding bracket of claim 1, wherein the anchor member includes a plurality of holes allowing the passing of a plurality of mechanical fasteners configured to attach and secure the anchor member to the stringer member of the staircase.

5. The angle adjustable tread holding bracket of claim 4, wherein the anchor member includes at least one oblong opening for the passing of at least one of the plurality of mechanical fasteners, wherein the at least one oblong opening allows a limited sliding motion along the stringer allowing spacing between the first and second bracket members to be adjusted.

6. The angle adjustable tread holding bracket of claim 1, wherein the angle is locked by tightening a pair of screws positioned in the second opening.

7. The angle adjustable tread holding bracket of claim 1, wherein the angle is adjustable from 30 to 45 degrees.

* * * * *